US005784977A

United States Patent [19]

Schell et al.

[11] Patent Number: 5,784,977

[45] Date of Patent: Jul. 28, 1998

[54] PONTOON FOR WATERCRAFT

[75] Inventors: Maurice L. Schell, Haslett; Ed Butcher, Corunna, both of Mich.

[73] Assignee: Maurell Products, Inc., Owosso, Mich.

[21] Appl. No.: 736,496

[22] Filed: Oct. 24, 1996

[51] Int. Cl.[6] ..... B63B 1/00

[52] U.S. Cl. ..... 114/61; 114/292

[58] Field of Search ..... 114/56, 57, 61, 114/62, 267, 288, 289, 296, 292; D12/300, 304, 314

[56] References Cited

U.S. PATENT DOCUMENTS

| | | | |
|---|---|---|---|
| 1,740,846 | 12/1929 | Van Dusen | 114/271 |
| 2,121,052 | 6/1938 | Roberts et al. | 114/292 |
| 2,342,023 | 2/1944 | Vidal et al. | 114/292 |
| 2,375,973 | 5/1945 | Cooper et al. | 114/292 |
| 2,391,326 | 12/1945 | McKinley | 114/291 |
| 3,361,104 | 1/1968 | Glass | 114/290 |
| 3,614,937 | 10/1971 | Schulman | 114/292 |
| 4,802,428 | 2/1989 | Lang | 114/61 |
| 5,184,561 | 2/1993 | Nickell, Jr. | 114/61 |

OTHER PUBLICATIONS

Maurell Products, Inc.; Johnson Outboards, Crest 1996 Fishing Series "We Have You Covered".

Maurell Products, Inc.; 1995 Crest Brochure.

Maurell Products, Inc.; 1996 Crest Brochure.

*Primary Examiner*—Ed L. Swinehart

*Attorney, Agent, or Firm*—Rockey, Milnamow & Katz, Ltd.

[57] ABSTRACT

An improved, planning pontoon boat has first and second spaced apart, elongated pontoons which exhibit a bow end and a stern end relative to the boat. A lower surface of each of the pontoons exhibits two intersecting planar members which terminate adjacent to respective elongated lift pads for the purpose of providing improved planing characteristics for the pontoons. The lift pads are each formed of intersecting concave surfaces. The lift pads extend radially from the pontoons and are located adjacent to the intersection of the planar surfaces and an upper curved surface of the pontoon. An elongated keel extends along the bottom of each of the pontoons, in the region where the planar elements intersect. The keel extends parallel to the lift pads.

20 Claims, 6 Drawing Sheets

PONTOON FOR WATERCRAFT

FIELD OF THE INVENTION

The invention pertains to boats and watercraft. More particularly, the invention pertains to an improved higher performance pontoon.

BACKGROUND OF THE INVENTION

Pontoon boats are well known and are a popular form of watercraft. They appeal to individuals who enjoy being on or near the water, but who like the greater stability and safety afforded by the pontoon-type structure.

Because of the structure, however, pontoon boats have historically traveled at low rates. Other types of watercraft, such as ski boats or boats with planing hulls are able to move comfortably through the water at speeds which are much greater than those normally achievable by known pontoon boats.

Known pontoon boats powered by outboard motors rarely exceed speeds of 30 mph comfortably. At higher speeds, it is common for water to spray up over the front of the boat and soak passengers and to spill on deck. In addition, the water tends to "beat" on the bottom surfaces of the known pontoons at higher speeds.

There are times when it would be desirable to combine the stability, load carrying capacity and roominess of pontoon boats with the higher speeds offered by other types of watercraft. This is especially important where the boats are used on especially large inland lakes or reservoirs such as those found in the South and in the West.

Thus, there is a continuing need for pontoon boats which can travel at higher rates of speed than known pontoon boats without sacrificing the stability and safety of those boats. Preferably, higher rates of speed could be achieved without substantially raising the manufacturing costs of such boats and without introducing additional maintenance requirements.

SUMMARY OF THE INVENTION

In accordance with the invention, an improved pontoon structure for use with watercraft includes an elongated, somewhat cylindrical housing. In one aspect of the invention, the housing can be closed. The housing has a front or bow end that tapers to a point and a planar or flat stern end.

The housing has an upper surface which is intended to extend or rise above the water through which the pontoon is traveling and a lower surface which is intended to be substantially submerged while the pontoon is traveling through the water. In accordance with the invention, the housing will plane when it is moved forward at a high enough rate of speed.

In one aspect of the invention, the housing can be formed with an upper partially cylindrical surface that is closed by two intersecting planes. The housing has a cross-section which has an upper curved portion which includes an arc that extends on the order of 120 degrees with the two ends of the arc joined by two intersecting linear elements. This crossection is present from the planar stern end to a region adjacent to the bow end.

The linear elements intersect at a keel region. The keel region is spaced equidistant from the two ends of the arc. The keel region itself can be formed as an elongated element with a trapezoidal crossection.

Thus, in accordance with one aspect of the invention, the pontoon is formed with two planar regions which intersect at an angle with respect to one another. The angle of intersection preferably is on the order of 140 degrees.

The shape of the pontoon is adapted so that the keel region is substantially submerged, along with the two adjacent planar regions. The planar regions provide lift as the portion is propelled through the water thereby providing a planing effect.

In yet another aspect of the invention, two lift elements or lift pads can be attached to the housing for the pontoon. The lift elements are elongated elements formed of two intersecting concave surfaces. These elements have a cross section which is symmetrical about a central bisecting plane.

The elongated lift pads or lift elements, in yet another aspect of the invention, extend along the housing for the pontoon at the region where the planar elements intersect the curved portion of the housing. The lift pads each preferably taper to a point near the bow end of the housing at a region where the planar elements fade back to a curved or circular crossection.

Each of the lift pads or lift elements preferably has a base region on the order or 3¼ inches wide. The two concave surfaces extend from the base region with radii on the order of 2¼ inches. In yet another aspect of the invention, the two concave surfaces are joined by a convex surface which could for example, be formed with a quarter inch radius.

Symmetrically located between the two lift elements or lift pads is an elongated keel which is attached to the housing at the elongated keel region. The keel has a somewhat rectangular crossection.

A pontoon structure in accordance with the present invention, exhibits an improved planing surface which in combination with the lift pads raises the pontoon partly out of the water, in response to an attached engine driving the pontoon through the water thereby reducing drag. As a result, a higher speed-to-horse power ratio can be achieved than the ratio which is achievable with prior art pontoon structures.

In yet another aspect of the invention, two pontoons can be coupled to an upper platform to provide a pontoon boat and a structure to which a gasoline engine can be attached. As a result of the present pontoon structure, such pontoon boats will exhibit improved planing characteristics and a higher speed-to-horse power ratio than theretofore achievable by known pontoon boats.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1A:
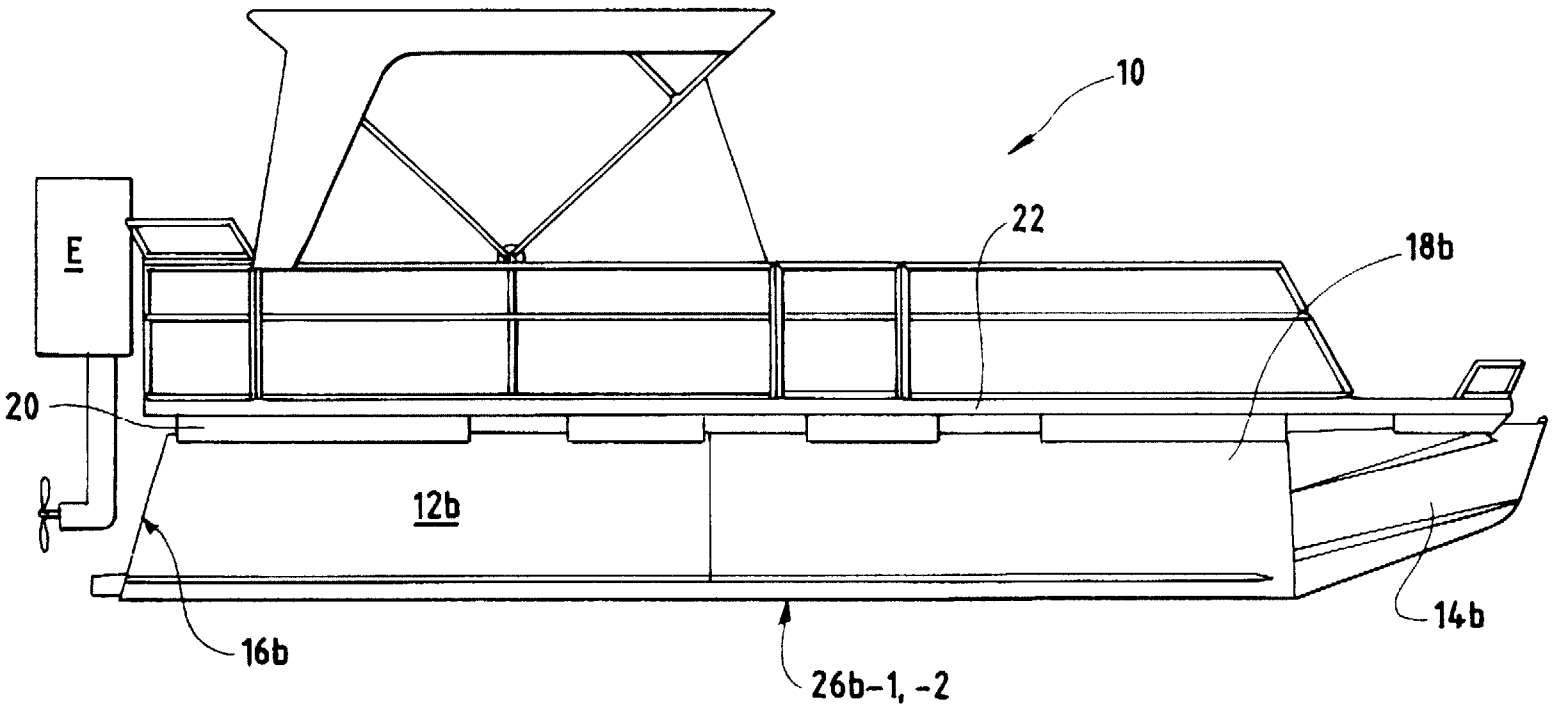
FIG. 1A is a side elevational view of a pontoon boat in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Figure 1B:
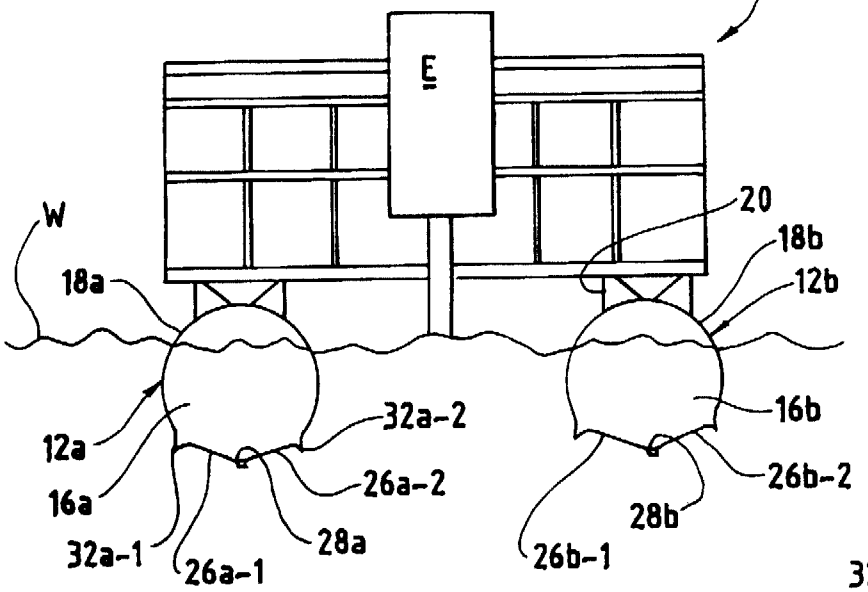
FIG. 1B is a rear elevational view of the pontoon boat of FIG. 1A.

FIGS. 1A and 1B illustrate side and rear views respectively of a pontoon boat 10 in accordance with the present invention. The boat 10 includes first and second spaced apart pontoons 12A and 12B. The pontoons are intended to float partially submerged in a fluid such as water W. The boat 10 is intended to be propelled through the water W by an engine E.

The pontoons 12A and 12B are substantially identical and a description of one will also describe the other. The pontoons each exhibit a front, or bow, tapered end 14*a, b* and a rear planar end 16*a, b*.

Each of the pontoons exhibits an upper curved surface, such as the surfaces 18*a*, 18*b*. The surfaces 18*a*, 18*b* in normal operation are supported out of the water W by the buoyancy of the respective pontoon. Carried on the surfaces 12*a*, 12*b*, are a plurality of brackets, such as bracket 20 which can be used to support an upper deck structure 22 of a type conventionally used with pontoon or house boats.

Figure 2:
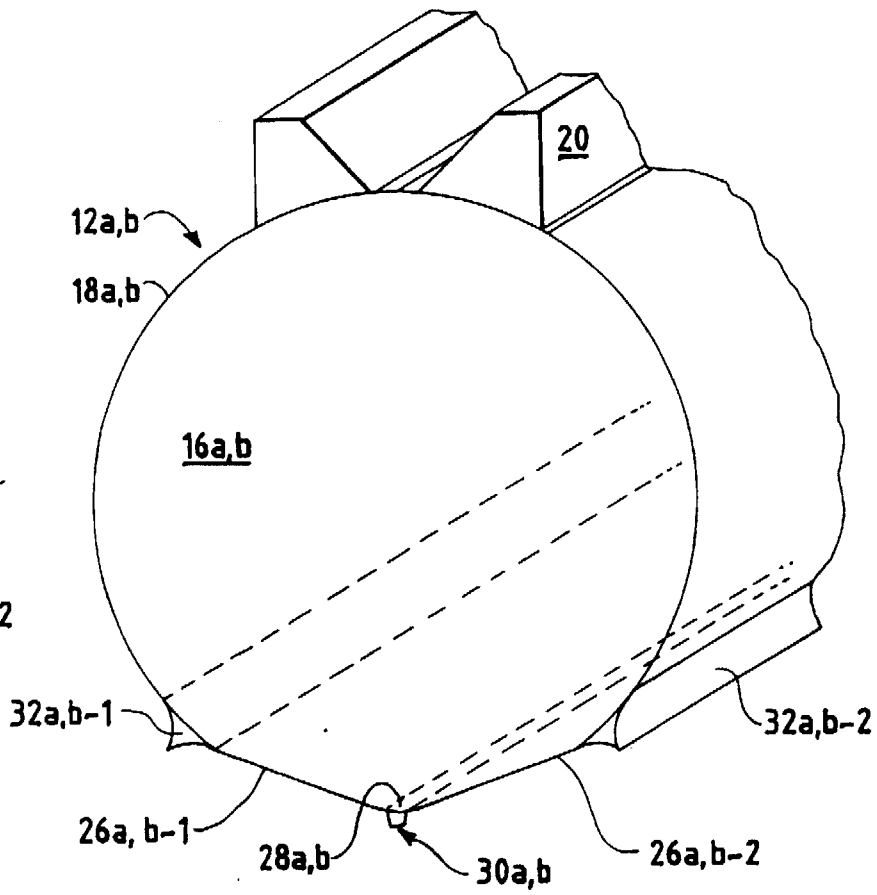
FIG. 2 is a partial, enlarged, perspective view of one of the pontoons illustrated in FIGS. 1A and 1B.

The upper surfaces 18*a*, 18*b* of each of the pontoons form an arc, in crossection, which is closed by first and second elongated planar elements 26*a*-1, 2 and 26*b*-1,2. (See FIG. 2) The planar elements 26*a*, 26*b* associated with each of the pontoons intersect at a keel region 28*a*, 28*b*. The keel regions 28*a*, 28*b* extend along the bottom surface of the respective pontoons 12*a*, 12*b*. Each keel region is equidistant from the ends of the respective curved surfaces 18*a*, 18*b*.

A keel 30*a, b* is attached to the respective keel region 28*a*, 28*b* and extends therefrom and along the respective pontoon. The keel has a generally rectangular crossection.

Lift pads 32*a*-1 and 32*a*-2 extend along and are carried by the pontoon 12*a*. The lift pads 32*a*-1, 2 are carried on and extend along the region where the curve surface 18*a* intersects the respective planar region 26*a*, 1-2. The lift pads 32*a*-1,2 are equidistant from the keel 28*a*. A corresponding pair of lift pads 32*b*-1, 2 is attached to and carried on pontoon 12*b*.

Figure 3:
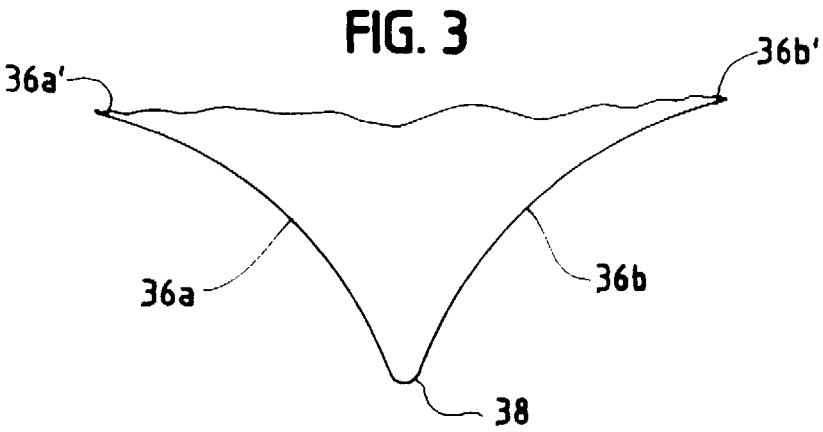
FIG. 3 is a view in section of a pontoon lift pad in accordance with the present invention.

Each of the lift pads is formed of first and second concave surfaces 36*a*, 36*b* best illustrated in FIG. 3. The surfaces 36*a*, 36*b* terminate at a common convex surface, a quarter inch radius 38. The other ends 36*a', b'* of the concave surfaces 36*a*, 36*b* are welded to the respective pontoon, best illustrated in FIG. 2, at a region where the respective planar surface such as 26*a*-1, intersects the respective curve surface, such as 18*a* of the respective pontoon.

Figure 4B:
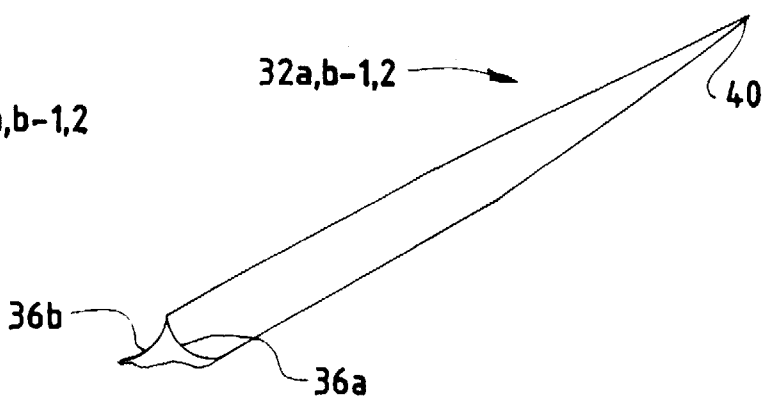
FIGS. 4A and 4B together are a perspective view of a lift pad in accordance with the present invention.
Figure 4A:
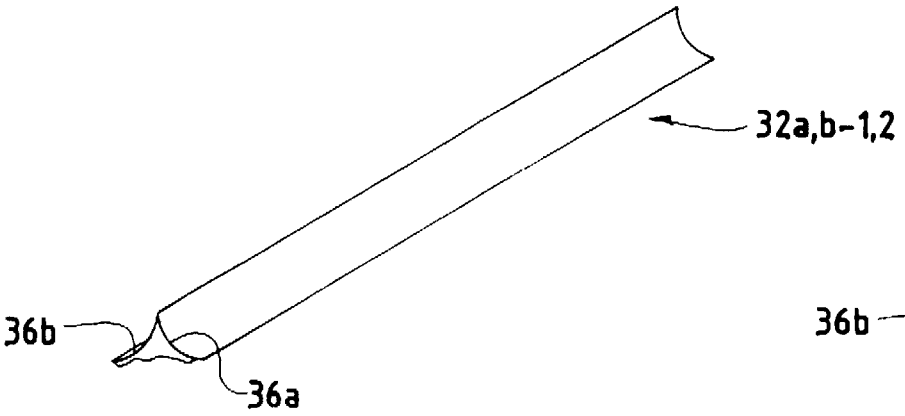

For convenience in manufacturing the lift pads can be formed in two sections, illustrated in FIGS. 4A and 4B. If desired, the lift pads can be formed as a single unit and then welded to the respective pontoon.

Figure 5A:
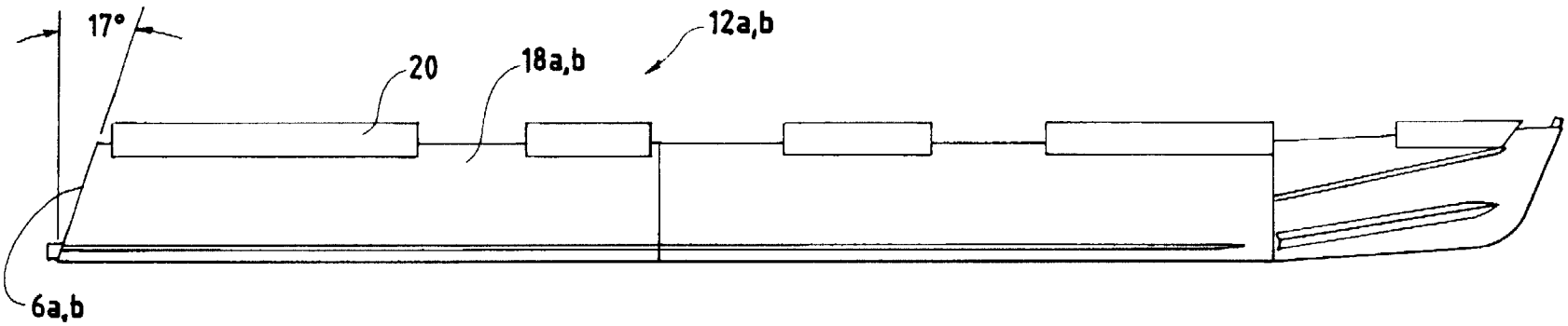
FIG. 5A is a side elevational view of a pontoon in accordance with the present invention.
Figure 5B:
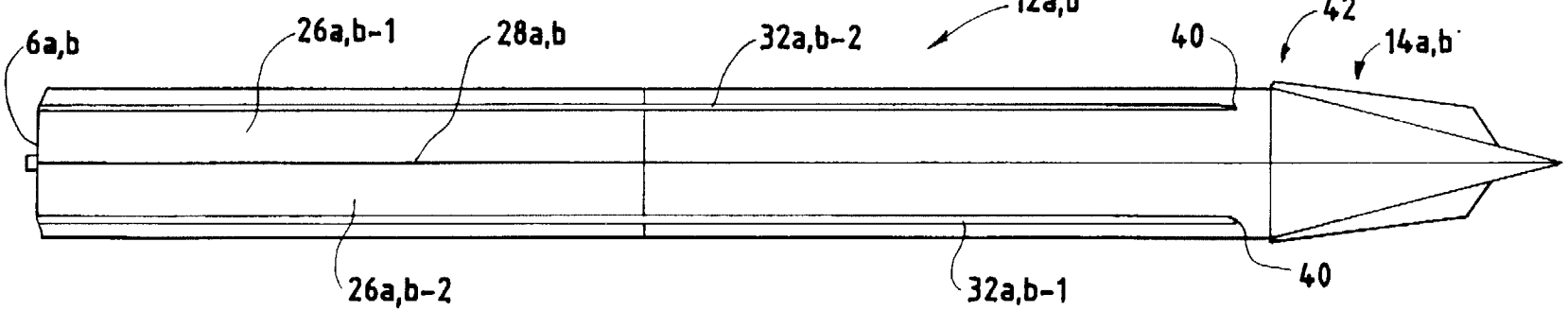
FIG. 5B is a bottom plan view of a pontoon in accordance with the present invention.

As illustrated in FIG. 4B, the portion of the lift element or pad adjacent to the front end 14*a, b* of the respective pontoon, tapers toward a point 40. The region where the front ends of the lift pads, the points 40 are located, corresponds to a portion 42 (see FIG. 5B) of the respective pontoon 12*a*, 12*b* wherein the planar elements, such as 28*a*, 28*b* fade from a flat back into a curved cross section. It is at the region 42, which exhibits a circular crossection that the front end or bow 14*a*, 14*b* of the respective pontoon is attached, best seen in FIGS. 5A, a side elevational view, and FIG. 5B, a bottom plan view.

The diameter of the curved sections of each of the pontoons 12*a*, 12*b*, is on the order of 27 inches. The length, exclusive of the front or the bow end can be varied based on the particular needs of a given pontoon boat. Lengths on the order of 10 to 35 feet or longer, if desired, come within the spirit and scope of the present invention.

The width of the planar elements, such as the elements 28*a*, 28*b*, can fall within a range of 6½ inches to 11¾ inches. A width of 9 inches is preferred.

The keel region 28*a, b* can have a width which falls in a range of ½ inch to ¾ of an inch with ½ inch being preferred. The planar elements, such as elements 26*a*-1, 26*a*-2 are oriented at an angle on the order of 140 degrees with respect to one another which falls in a range of 120° to 160°. This corresponds to an angle on the order of 21 degrees from a horizontal with respect to each of those planar elements. Preferably, each of the elements will be at an angle which falls in a range of 13 degrees to 28 degrees with respect to a horizontal.

The concave surfaces of each of the lift pads, such as lift pads 38*a*-1, 2 have a radius which falls in a range of 2⅛ inches to 3¼ inches. A radius on the order of the 2¼ inches is preferred. The attachment surfaces 36*a'* and 36*b'* of each of the lift pads are spaced apart from one another on the order of 3¼ inches.

The rear planar element 16*a, b* is oriented at an angle with respect to a vertical on the order of 15 to 23 degrees. An angle of 17 degrees is preferred.

Figure 6:
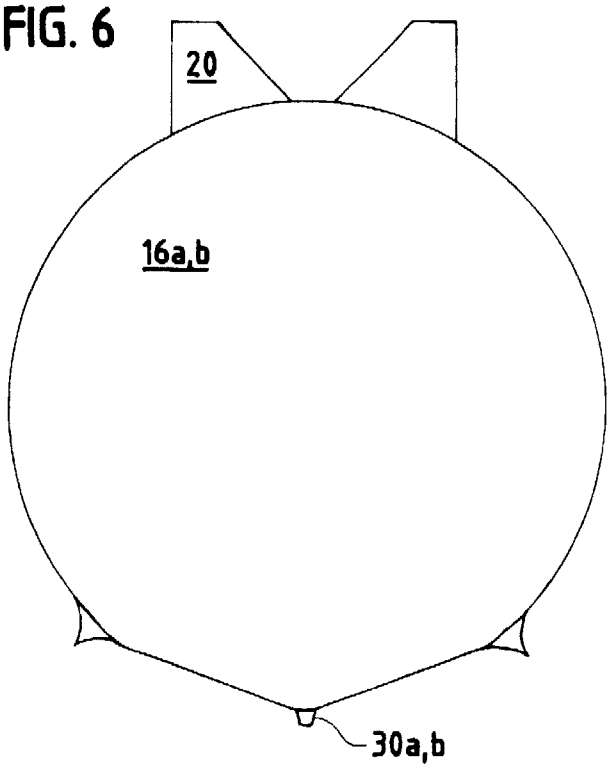
FIG. 6 is a rear elevational view of a pontoon in accordance with the present invention.

FIG. 6 illustrates a rear elevational view corresponding to each of the pontoons 12*a, b*.

Figure 7:
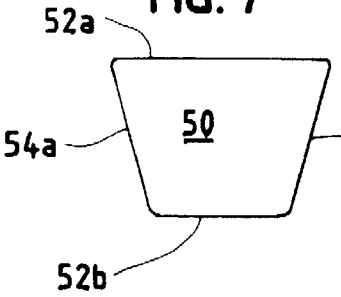
FIG. 7 is an end plan view of a pontoon in accordance with the present invention.

FIG. 7 is an end plan view of a keel such as keel element 30*a* or 30*b* in accordance herewith. The keel element includes a body 50 which has a surface 52*a* for attachment (by welding) to the respective pontoon and a displaced parallel surface 52*b*.

The linear surfaces 52*a*, 52*b* are bounded by two additional surfaces 54*a, b* as illustrated in FIG. 7. Hence the keel element is trapezoidal in crossection.

Figure 8:
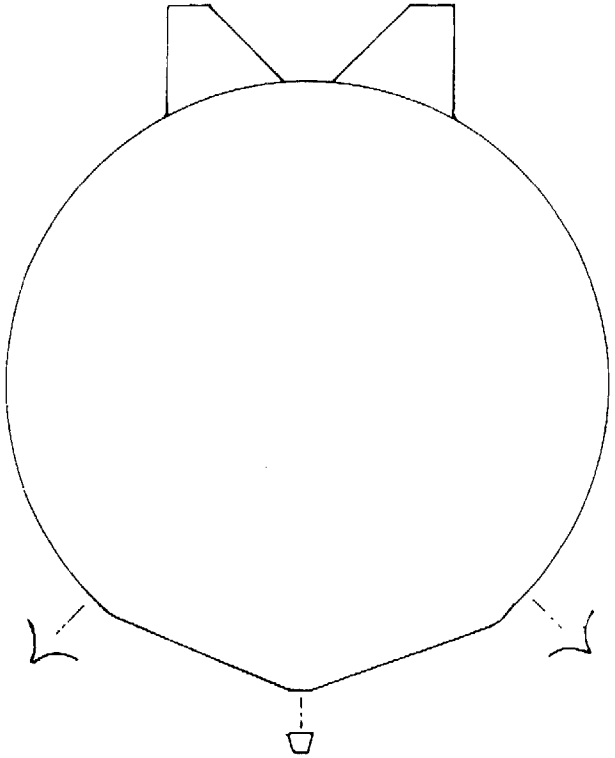
FIG. 8 is a view illustrating manufacture of a pontoon in accordance with the present invention.

FIG. 8 illustrates a method of manufacturing a pontoon, such as pontoons 12*a*, 12*b* in accordance with the present invention.

In an initial step, the tubular portion of each of the pontoons is formed. This tubular portion, which preferably is formed of aluminum sheet, can be formed from a single sheet of aluminum or can be formed of multiple sheets which are welded together without departing from the spirit and scope of the present invention. Each of the pontoons is formed with a 27 inch diameter tubular section, exclusive of the front of bow end 14*a*, 14*b*.

Each of the pontoons as described previously is formed with two opposing 9 inch wide 21 degree planar elements or flats which intersect at a half inch wide planar keel region. The planar regions extend from the stern end planar plate, 12*a, b*, of each of the pontoons toward the bow end and fade to round in the vicinity 42 of the front end 14*a*, 14*b*.

The two lift pads, such as lift pads 38*a*-1,2 are welded to the tubular portion after the keel, such as the keel 30*a* has been attached. All of the elements including the keel are preferably formed of aluminum.

Preferably the lift pads will be welded to the tubular elements at a region on the order of 9/16 of an inch, from where the curved section of each of the pontoons intersects the elongated planar elements. (See FIG. 6). The bow end 14*a*, 14*b*, which can assume a variety of shapes without departing from the spirit and scope of the present invention, is welded to the tubular front portion 42 of the pontoon.

Pontoons in accordance with the present invention when assembled as described above produce an improved and extensive planning surface. The planning surface, formed in part of the planar elements 26*a*-1, 2 of each pontoon adds lift and surprisingly achieves a much improved and higher speed-to-horsepower ratio than that provided by known pontoon structures.

Figure 9:
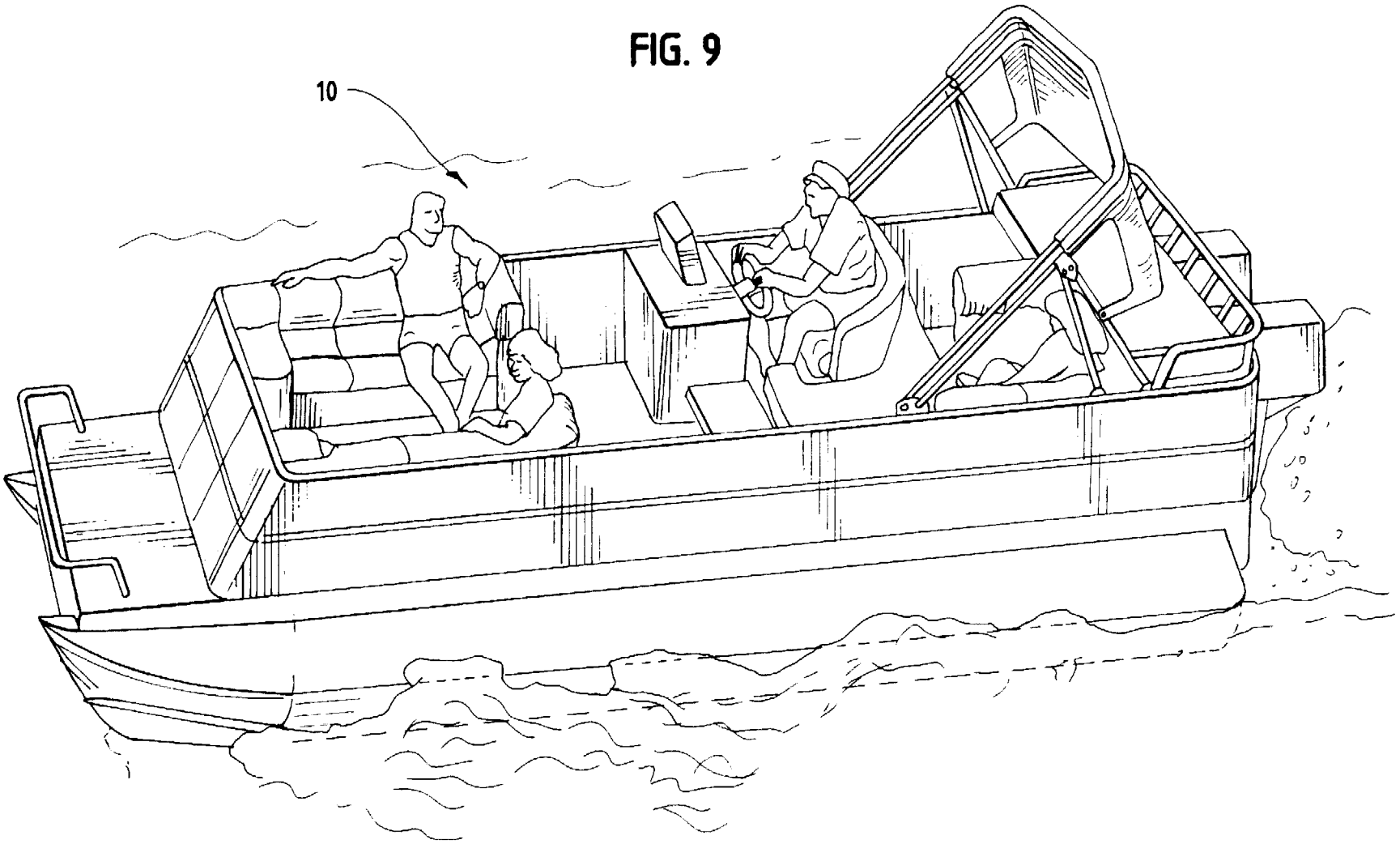
FIG. 9 is a perspective view of a pontoon boat in accordance with the present invention illustrative its planning characteristics.

FIG. 9 illustrates a 22 foot long high performance pontoon boat 10 driven by a 154 horsepower outboard engine. FIG. 9 illustrates the surprising and unusual results obtained with the present invention. Boats such as the boat 10 in FIG. 9, when carrying two adults have been clocked using radar at speeds in excess of 50 mph. The high performance pontoons illustrated herein and in FIG. 9 have a 27 inch diameter. Standard pontoons that have 25 inch diameters and standard circular crossections. When used with the same 22 foot boat, the same engine and same two adult load standard pontoons and the associated 22' boat can be expected to reach speeds in a range of 32–36 miles per hour instead of in excess of 50 m.p.h.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A structure for floatably supporting an object on a fluid comprising:

an elongated housing having a submerged surface and an exposed surface when floating at rest on the fluid and having first and second, spaced apart elongated, lift elements affixed to and extending along the housing on said submerged surface wherein each of the lift elements includes first and second concave surfaces symmetrically located with respect to a center line of the respective lift element, wherein said housing includes first and second elongated planar regions extending along the housing and located between the lift elements, said planar regions forming a portion of said submerged surface, wherein the planar regions intersect at a keel region equidistant from the lift elements.

2. A structure as in claim 1 wherein the planar regions intersect at an angle that falls in a range of 120 degrees to 160 degrees.

3. A structure as in claim 1 wherein the concave surfaces are joined by a convex surface.

4. A structure as in claim 1 wherein one end of said housing is planar and a respective other end is non-planar.

5. A structure as in claim 4 wherein the planar end is oriented at an angle in a range of 15–23 degrees relative to a vertical.

6. A structure as in claim 1 wherein each of the planar regions is oriented to intersect the horizontal plane at an angle that falls in a range of 10 to 30 degrees.

7. A pontoon for a watercraft comprising:

an elongated, closed housing wherein the housing has first and second spaced apart ends and wherein at least a part of the housing has a closed cross-section formed of a continuous curved region having third and fourth spaced apart ends which are joined by first and second planar regions which intersect at an angle in excess of ninety degrees at a keel region which is equidistant from the third and fourth ends and a keel member extending downwardly from said keel region, and wherein the housing is intended to be propelled through the water with the keel region substantially submerged;

first and second, elongated, lift extensions wherein each of said extensions is coupled to said housing at the intersection of said curved and said planar regions and is coextensive therewith and wherein said keel region is located equidistant from said lift extensions, wherein the lift extensions are each formed with opposed concave surfaces.

8. A pontoon as in claim 7 wherein the planar regions intersect at a range of 120 degrees to 160 degrees.

9. A pontoon as in claim 7 wherein the planar regions intersect at an angle on the order of 140 degrees.

10. A pontoon as in claim 7 wherein the concave surfaces of each extension are joined by a convex surface.

11. A pontoon as in claim 7 wherein one end of the housing is substantially flat.

12. A pontoon as in claim 11 wherein the substantially flat end is oriented to extend upwardly and tilted toward the other end of the housing.

13. A pontoon as in claim 12 wherein the other end of the housing is curved.

14. A pontoon as in claim 7, wherein said housing is formed of aluminum and wherein said lift extensions comprise rigid aluminum elements, and said keel member comprises a rigid aluminum element, said lift extensions and said keel member welded to said housing.

15. A structure for floatably supporting an object on a fluid comprising:

an elongated housing having first and second, spaced apart, elongated, lift elements affixed to and extending along the housing wherein each of the lift elements includes first and second concave surfaces symmetrically located with respect to a center line of the respective lift element, and first and second elongated planar regions extending along the housing and located between the lift elements, wherein the planar regions intersect at a keel region equidistant from the lift elements.

16. A structure as in claim 15 wherein the planar regions intersect at an angle that falls in a range of 120 degrees to 160 degrees.

17. A pontoon for a watercraft comprising:

an elongated, closed housing wherein the housing has first and second spaced apart ends and wherein at least a part of the housing has a closed cross-section formed of a continuous curved region having third and fourth spaced apart ends which are joined by first and second planar regions which intersect at an angle in excess of ninety degrees at a keel region which is equidistant from the third and fourth ends and wherein the housing is intended to be propelled through the water with the keel region substantially submerged;

first and second, elongated, lift extensions wherein each of the extensions is coupled to the housing at the intersection of the curved and the planar regions and is coextensive therewith and wherein the keel region is located equidistant from the lift extensions; and wherein the lift extensions are each formed with opposed concave surfaces.

18. A pontoon as in claim 17 wherein the planar regions intersect at a range of 120 degrees to 160 degrees.

19. A pontoon as in claim 17 wherein the planar regions intersect at an angle on the order of 140 degrees.

20. A pontoon as in claim 17 wherein the concave surfaces of each extension are joined by a convex surface.

* * * * *